US006807784B2

(12) United States Patent
Hsueh

(10) Patent No.: US 6,807,784 B2
(45) Date of Patent: Oct. 26, 2004

(54) COMBINATION PARTITION SCREEN AND HANGING STRUCTURE FOR USE IN A COMBINATION PARTITION SCREEN

(76) Inventor: Yi-Cheng Hsueh, No. 28-1, Lane 195, Yung Fong Road, Tu Cheng, Taipei Hsien (TW)

( * ) Notice: Subject to any disclaimer, the term of this patent is extended or adjusted under 35 U.S.C. 154(b) by 0 days.

(21) Appl. No.: 10/292,475

(22) Filed: Nov. 13, 2002

(65) Prior Publication Data

US 2003/0066248 A1 Apr. 10, 2003

Related U.S. Application Data

(62) Division of application No. 09/832,001, filed on Apr. 11, 2001, now Pat. No. 6,553,731.

(30) Foreign Application Priority Data

Apr. 12, 2000 (TW) ..... 89205851 U
Jul. 31, 2000 (TW) ..... 89213242 U

(51) Int. Cl.[7] ..... E04C 2/34
(52) U.S. Cl. ..... 52/481.2; 52/36.8; 52/36.5; 211/87.01; 211/94.01
(58) Field of Search ..... 52/481.2, 36.8, 52/36.5; 211/87.01, 94.01

(56) References Cited

U.S. PATENT DOCUMENTS 3,556,308 A * 1/1971 McAleenan ..... 211/134
3,698,565 A * 10/1972 Weber ..... 211/87.01
4,209,098 A * 6/1980 Adams ..... 211/70.8
4,961,295 A * 10/1990 Kosch et al. ..... 52/36.5
5,018,323 A * 5/1991 Clausen ..... 52/36.4
5,189,850 A * 3/1993 Felton ..... 52/36.4
5,241,796 A * 9/1993 Hellwig et al. ..... 52/36.4
5,309,686 A * 5/1994 Underwood et al. ..... 52/29
5,360,121 A * 11/1994 Sothman ..... 211/87.01
5,412,912 A * 5/1995 Alves ..... 52/36.5
5,941,026 A * 8/1999 Eisenreich et al. ..... 52/36.5
6,065,262 A * 5/2000 Motta ..... 52/582.1
6,349,507 B1 * 2/2002 Muellerleile ..... 52/36.5
6,421,961 B1 * 7/2002 Mallozzi ..... 52/36.5
6,547,086 B1 * 4/2003 Harvey ..... 211/87.01
6,553,731 B2 * 4/2003 Hsueh ..... 52/239
6,581,788 B1 * 6/2003 Winig et al. ..... 211/90.01
2003/0189020 A1 * 10/2003 Secondino ..... 211/94.01

* cited by examiner

*Primary Examiner*—Carl D. Friedman
*Assistant Examiner*—Steve Varner
(74) *Attorney, Agent, or Firm*—Troxell Law Office PLLC

(57) ABSTRACT

A combination partition screen includes at least two upright supports, each upright support having a plurality of longitudinal coupling portions in corners thereof and a plurality of spacers respectively mounted between each two adjacent upright supports to support partition panels, each spacer having a flat base wall, a flat bearing wall and a flat supporting wall respectively extended from the base wall, an upward stop flange extended from the flat bearing wall and adapted to hold with the flat base wall a partition panel on the flat bearing wall, a downward stop flange extended from the flat supporting wall and adapted to hold with the flat base wall a partition panel below the flat supporting wall, a downward locating flange extended from the flat bearing wall and defining with the flat supporting wall an elongated coupling chamber for hanging things, a flat positioning wall perpendicularly extended from an opposite side of the flat base wall on the middle, an elongated clamping wall extended from the flat positioning wall, and two coupling notches disposed on two ends of the flat positioning wall between the flat base wall and the flat positioning wall and respectively coupled to two adjacent upright supports.

6 Claims, 7 Drawing Sheets

COMBINATION PARTITION SCREEN AND HANGING STRUCTURE FOR USE IN A COMBINATION PARTITION SCREEN

RELATED APPLICATION

This is a Divisional application of U.S. Ser. No. 09/832,001, filed Apr. 11, 2001 now U.S. Pat. No. 6,553,731, entitled COMBINATION PARTITION SCREEN AND HANGING STRUCTURE FOR USE IN A COMBINATION PARTITION SCREEN, and currently pending.

BACKGROUND OF THE INVENTION

1. Field of the Invention

The present invention relates to a combination partition screen and, more particularly, to such a combination partition screen that can easily quickly be set up. The invention relates also to hanging devices for use on the combination partition screen.

2. Description of Related Art

Partition screens are commonly used to separate the room or house into separated spaces for different purposes for the advantage of low cost, high mobility, and being detachable and highly adjustable.

According to conventional partition screen construction methods, the connection between the partition panels and the upright supports (studs) can be achieved by hanging as indicated in U.S. Pat. No. 5,664,380 (equivalent to Taiwan Patent No. 101835), or engagement as indicated in U.S. Pat. No. 5,855,100 (equivalent to Taiwan Patent No. 141448). According to these two connection methods, coupling elements are provided at the back sidewall of the partition panels for fastening to the front or back side of the upright supports (studs). The use of the coupling elements complicates the procedure of the installation procedure of the partition panels.

Further, due to structural strength problem, it is not suitable to fasten an article, for example, a table board or storage rack to a partition screen with nails or screws. According to U.S. Pat. No. 3,778,939, each stud has flange portions at two opposite sides and slots in the flange portion for the mounting of a bracket selectively, and support boards are respectively supported on brackets between studs for holding things. According to this design, brackets must be mounted on the studs so that storage items can be carried between studs. This design limits the arrangement of storage items.

SUMMARY OF THE INVENTION

The present invention has been accomplished under the circumstances in view. According to one aspect of the present invention, the combination partition screen comprises at least two upright supports, each upright support comprising a plurality of longitudinal coupling portions in corners thereof and a plurality of spacers respectively mounted between each two adjacent upright supports to support partition panels, each spacer comprising a flat base wall, a flat bearing wall and a flat supporting wall respectively extended from the base wall, an upward stop flange extended from the flat bearing wall and adapted to hold with the flat base wall a partition panel on the flat bearing wall, a downward stop flange extended from the flat supporting wall and adapted to hold with the flat base wall a partition panel below the flat supporting wall, a downward locating flange extended from the flat bearing wall and defining with the flat supporting wall an elongated coupling chamber for hanging things, a flat positioning wall perpendicularly extended from an opposite side of the flat base wall on the middle, an elongated clamping wall extended from the flat positioning wall, and two coupling notches disposed on two ends of the flat positioning wall between the flat base wall and the flat positioning wall and respectively coupled to two adjacent upright supports.

According to another aspect of the present invention, the spacers each further comprise a first recessed portion provided in the elongated flat bearing wall between the elongated flat base wall and the upward stop flange at a top side and a second recessed portion in the elongated flat supporting wall between the elongated flat base wall and the downward stop flange at a bottom side for the mounting of packing strips.

Further, carriers may be used to support attached heavy devices. The carriers each comprise a center box and two spacer units at two sides of the center box. The spacer units work same as the spacers.

BRIEF DESCRIPTION OF THE DRAWINGS

The present invention can be more fully understood by referring to the following description and accompanying drawings, in which.

DETAILED DESCRIPTION OF THE PREFERRED EMBODIMENTS

Figure 1:
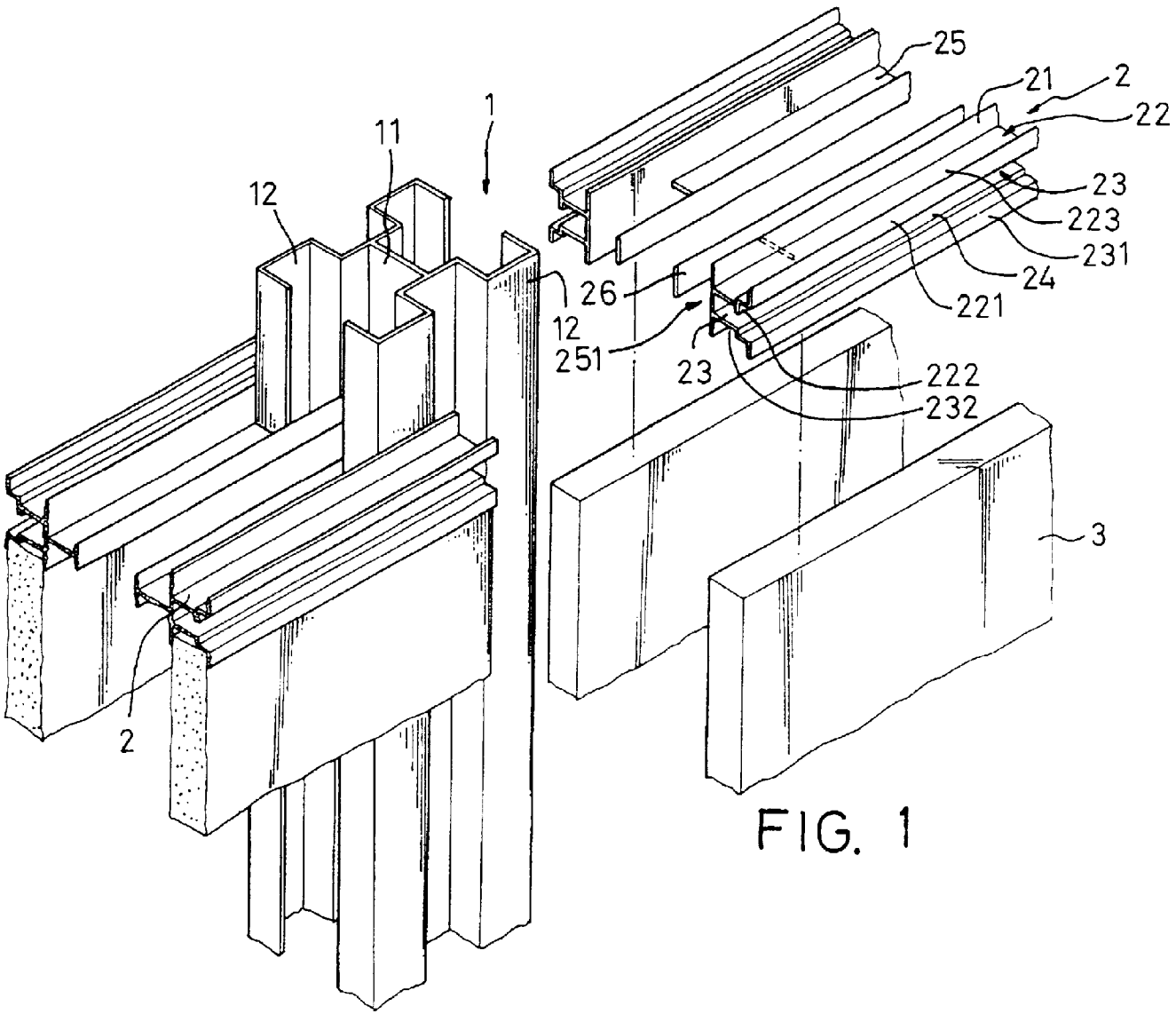
FIG. 1 is an exploded view of a combination partition screen according to the present invention.
Figure 3:
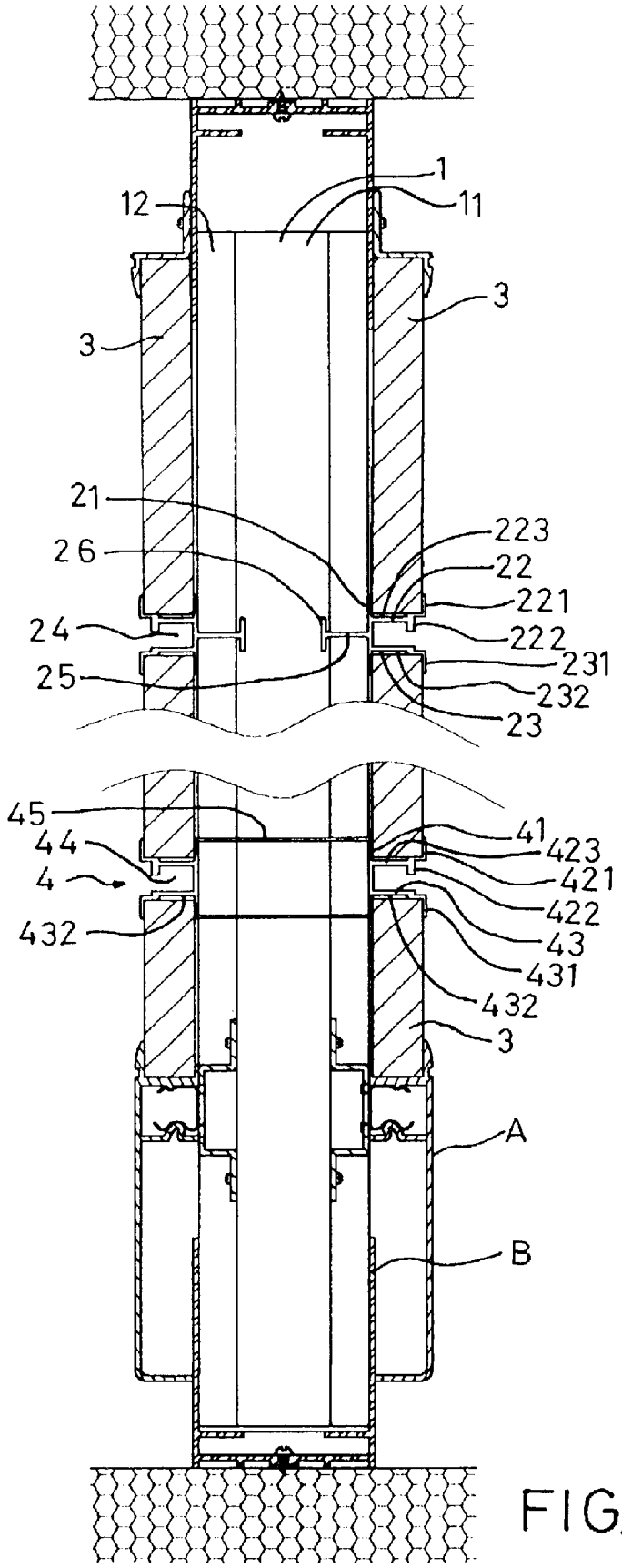
FIG. 3 is a sectional assembly view of the present invention.

Referring to FIG. 1 and FIG. 3, a combination partition screen in accordance with the present invention comprises at least two upright supports 1, a plurality of spacers 2 respectively connected between the upright supports 1, and a partition panel 3 sandwiched in between each two spacers 2.

The upright support 1 is an elongated profiled member comprising a longitudinal base plate 11, and at least two longitudinally extended coupling portions 12 bilaterally disposed at one side of the base plate 11. Preferably, four coupling portions 12 are respectively provided in four corners at two sides of the base plate 11 for the connection of the spacers 2.

The spacer 2 is an elongated profiled member comprising an elongated flat base wall 21, an elongated flat bearing wall 22 perpendicularly extended from the front side of the flat base wall 21, an upward stop flange 221 extended from the free end of the elongated flat bearing wall 22 and adapted to hold with the elongated flat base wall 21 a partition panel 3 on the elongated flat bearing wall 22, an elongated flat supporting wall 23 perpendicularly extended from the front side of the flat base wall 21 below the elongated flat bearing wall 21, a downward stop flange 231 extended from the free end of the elongated flat supporting wall 23 and adapted to hold with the elongated flat base wall 21 a partition panel 3 at the bottom side of the elongated flat supporting wall 23, a downward locating flange 222 extended from the free end of the elongated flat bearing wall 22 and defining with the elongated flat supporting wall 23 an elongated coupling chamber 24.

Furthermore, an elongated flat positioning wall 25 perpendicularly extended from the back side of the elongated flat base wall 21 on the middle, an elongated clamping wall 26 extended along the free end of the elongated flat positioning wall 25, and a coupling notch 251 on each end of the elongated flat positioning wall 25 between the elongated flat base wall 21 and the elongated flat positioning wall 25 fitting the coupling portions 12 of each upright support 1. When forcing the coupling notch 251 on one end of the elongated flat positioning wall 25 of the spacer 2 into engagement with one coupling portion 12 of one upright support 1, the spacer 2 can be moved along the upright support 1 to the desired elevation.

Further, recessed portions 223 and 232 are respectively provided at the top side of the elongated flat bearing wall 22 between the elongated flat base wall 21 and the upward stop flange 221 and the bottom side of the elongated flat supporting wall 23 between the elongated flat base wall 21 and the downward stop flange 231 for the mounting of packing strips (not shown) to facilitate the positioning of the partition panels 3.

Referring to FIG. 3 and FIG. 1 again, the upright supports 1 are respectively fixedly fastened to respective mounting holes B adjacent to respective kick plates A. After one partition panel 3 has been mounted on one kick plate A and stopped between two upright supports 1, one spacer 2 is coupled with its two coupling notches 251 to the two adjacent upright supports 1 and moved downwards along the upright supports 1 to force the elongated flat supporting wall 23 into contact with the topmost edge of the installed partition panel 3, and then a second partition panel 3 is put in between the two adjacent upright supports 1 and supported on the elongated flat bearing wall 22 of the installed spacer 2, and then a second spacer 2 is coupled to the two adjacent upright supports 1 and lowered to force its elongated flat supporting wall 23 into contact with the topmost edge of the second partition panel 3. By means of repeating this procedure, a partition screen is easily set up subject to the desired height. When assembled, the partition panels 3 are respectively stopped in place by the upward stop flange 221 and downward stop flange 231 of each spacer 2. Further, the partition panels 3 can be cut to the desired height so as to change the elevations of the spacers 2 in the combination partition screen to be set up.

Figure 2:
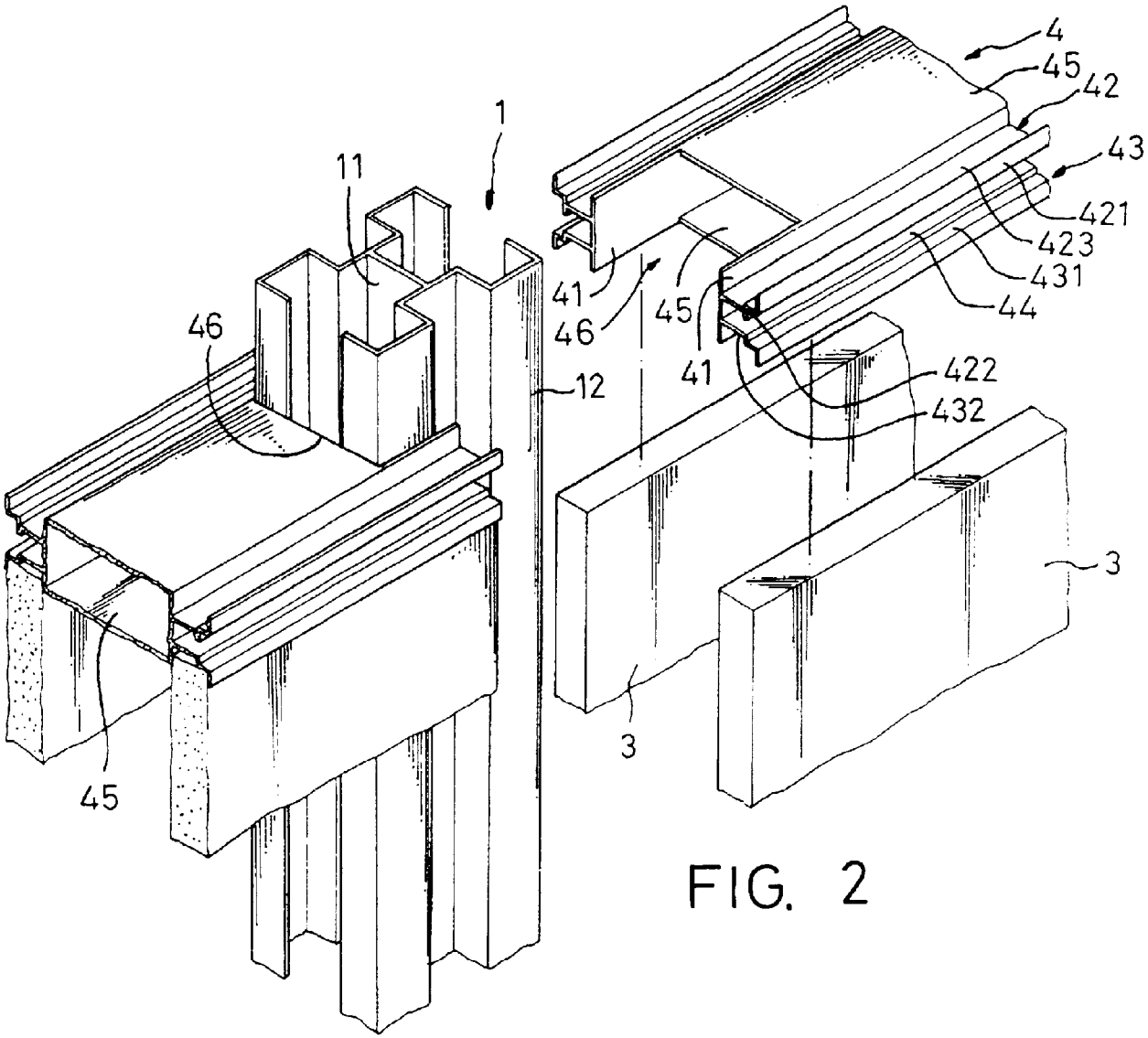
FIG. 2 is an exploded view of an alternate form of the combination partition screen according to the present invention.

Referring to FIG. 2 and FIG. 3, a carrier 4 may be provided between two horizontally aligned spacers 2 to support a heavy object, for example, a table board. The carrier 4 is a flat, hollow, profiled frame member comprising a flat center box 45 corresponding to the width of the upright support 1, two end coupling notches 46 at two ends of the center box 45 corresponding to one half of the depth of the upright support 1, and two spacer units at two sides of the center box 45 and the end coupling notches 46. The structure of the spacer units is similar to the aforesaid spacers 2, each comprising an elongated flat base wall 41, an elongated flat bearing wall 42 perpendicularly extended from the front side of the flat base wall 41, an upward stop flange 421 extended from the free end of the elongated flat bearing wall 42 and adapted to hold with the elongated flat base wall 41 a partition panel 3 on the elongated flat bearing wall 42, an elongated flat supporting wall 43 perpendicularly extended from the front side of the flat base wall 41 below the elongated flat bearing wall 41, a downward stop flange 431 extended from the free end of the elongated flat supporting wall 43 and adapted to hold with the elongated flat base wall 41 a partition panel 4 at the bottom side of the elongated flat supporting wall 43, a downward locating flange 422 extended from the free end of the elongated flat bearing wall 42 and defining with the elongated flat supporting wall 43 an elongated coupling chamber 44. Further, recessed portions 423 and 432 are respectively provided at the top side of the elongated flat bearing wall 42 between the elongated flat base wall 41 and the upward stop flange 421 and the bottom side of the elongated flat supporting wall 43 between the elongated flat base wall 41 and the downward stop flange 431 for the mounting of packing strips (not shown) to facilitate the positioning of the partition panels 3.

The installation of the carrier 4 is outlined thereinafter with reference to FIGS. 2 and 3 again. The end coupling notches 46 of the carrier 4 are respectively coupled to two adjacent upright supports 1, and then the carrier 4 is lowered to force the elongated flat supporting wall 43 of each of the two spacer units thereof against the topmost edge of each partition panel 3 between the two adjacent upright supports 1, and then another two partition panels 3 are coupled to the two adjacent upright supports 1 and respectively supported on the elongated flat bearing wall 42 of each of the two spacer units of the carrier 4. After setting of a combination partition screen, the user can hung things on the spacers 2 or the carriers 4 at either side of the combination partition screen as desired.

Figure 4:
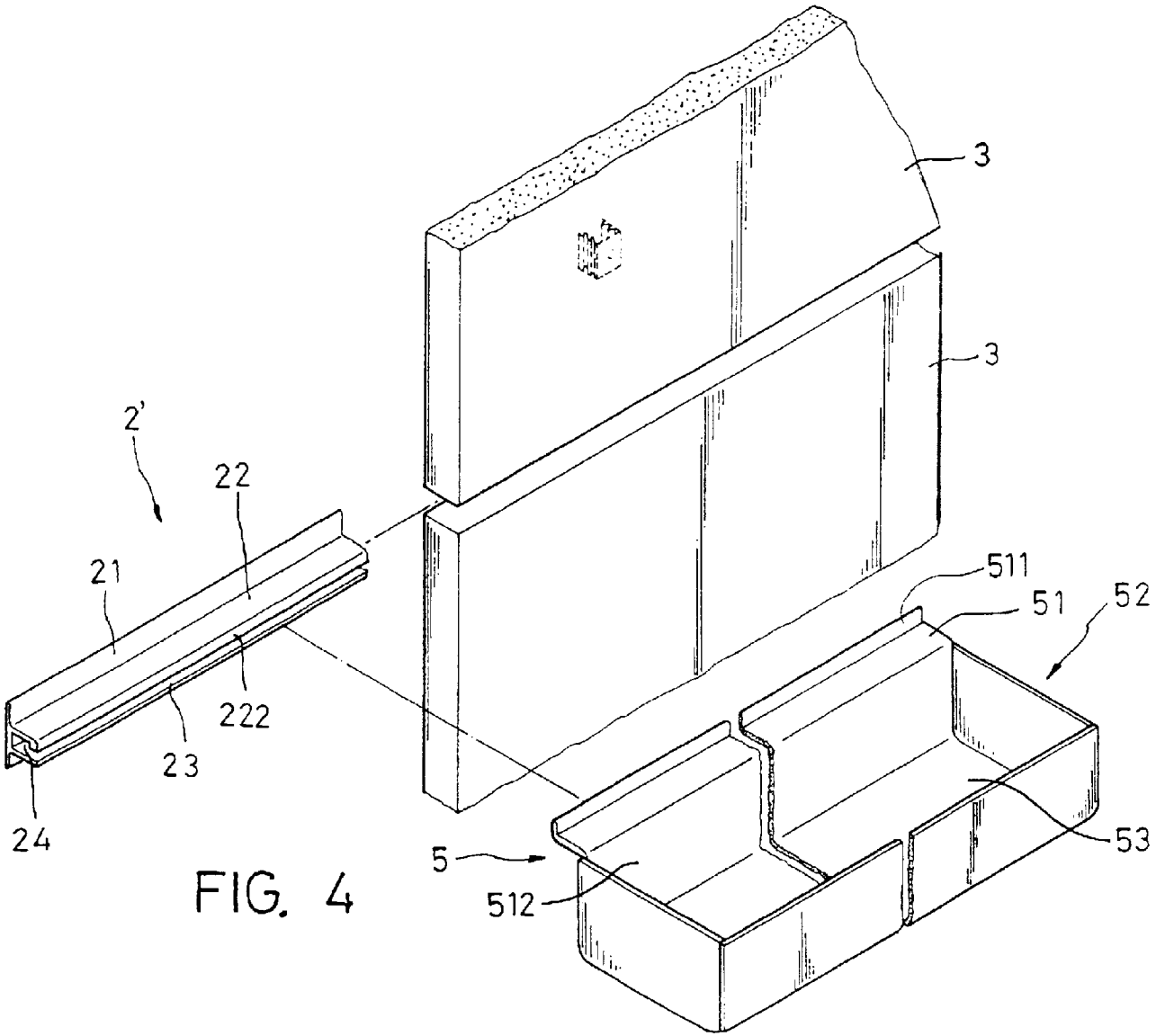
FIG. 4 is an exploded view of another alternate form of the combination partition screen according to the present invention.

FIG. 4 shows an alternate form of the spacer. According to this alternate form, the spacer 2' comprises an elongated flat base wall 21 disposed in contact with the back sidewall of each of two vertically spaced partition panels 3, an elongated flat bearing wall 22 and elongated flat supporting wall 23 perpendicularly extended from the elongated flat base wall 21 at different elevations and supported in between the two vertically spaced partition panels 3, a downward stop flange 222 extended from the free end of the elongated flat bearing wall 22 and defining with the elongated flat base wall 21 and the elongated flat supporting wall 23 an elongated coupling chamber 24.

In the embodiment shown in FIG. 1, the elongated flat bearing wall 22, elongated flat supporting wall 23 and elongated coupling chamber 24 of each spacer 2 form a hanging structure for hanging things. In the embodiment shown in FIG. 2, the elongated flat bearing wall 42, elongated flat supporting wall 43 and elongated coupling chamber 44 of each spacer unit of the carrier 4 form a hanging structure for hanging things. In the embodiment shown in FIG. 4, the elongated flat bearing wall 22, elongated flat supporting wall 23 and elongated coupling chamber 24 of the spacer 2' form a hanging structure for hanging things.

Referring to FIGS. from 4 through 7, a hanging device 5 is hung on the hanging structure of spacer 2' to hold or support things. The hanging device 5 can be a box, rack, or plate member, comprising a vertical back sidewall 512, a horizontal extension plate 51 backwardly extended from the topmost edge of the vertical back sidewall 512, and a coupling flange 511 upwardly extended from the free end of the horizontal extension plate 51 remote from the vertical back sidewall 512. The height of the coupling flange 511 is slightly greater than the distance between the downward locating flange 222 and the elongated flat supporting wall 23. During installation, the coupling flange 511 is inserted into the elongated coupling chamber 24 of the spacer 2', and then the hanging device 5 is turned downwards to force the coupling flange 511 into engagement wit the downward locating flange 222 of the spacer 2', keeping the vertical back sidewall 512 supported on the front sidewall of the lower partition panel 3. Further, the front side of the hanging device 5 is provided with a holder 52 adapted to hold or support things.

Figure 5:
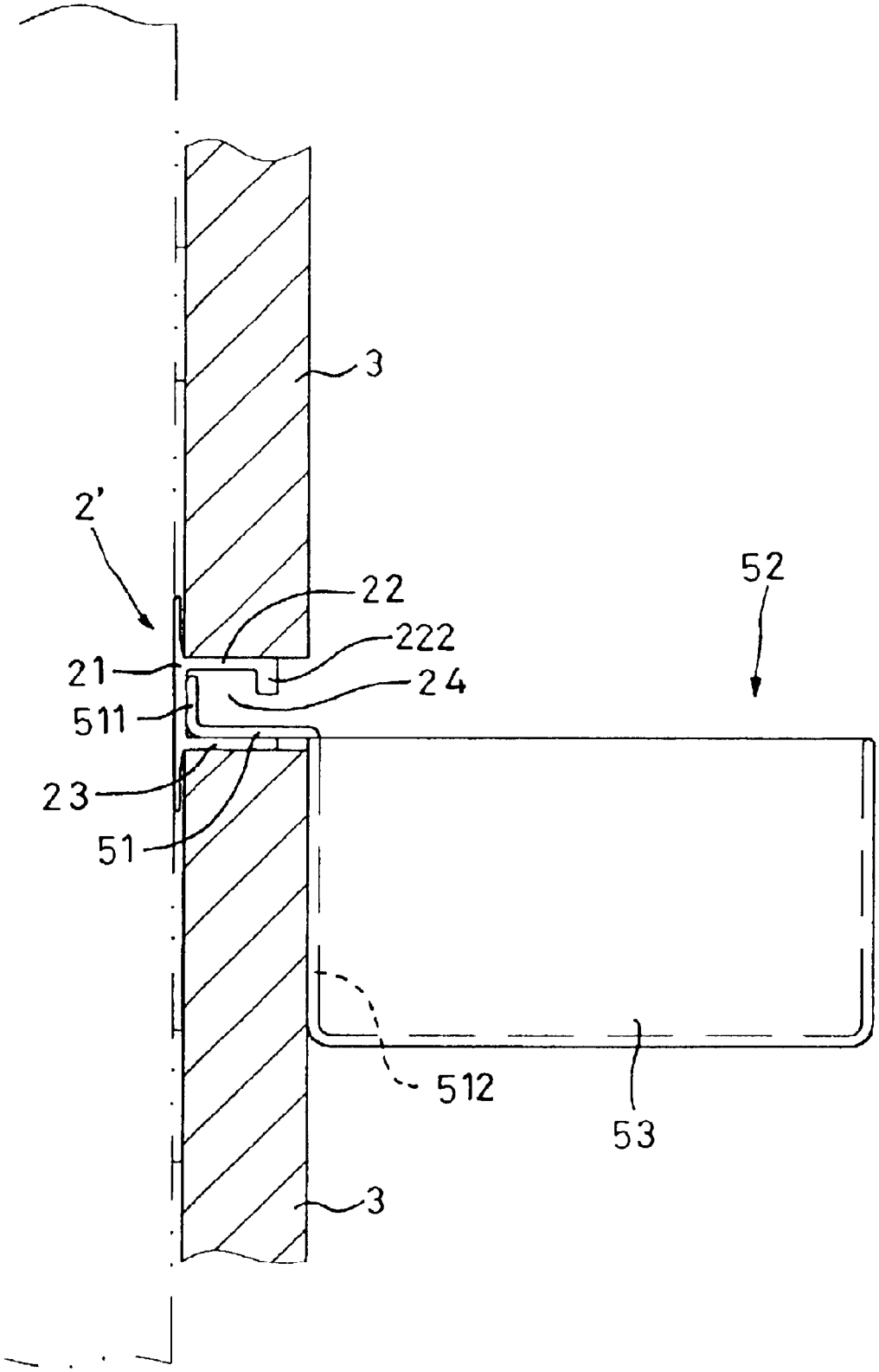
FIG. 5 is a sectional assembly view of FIG. 4.

In the embodiment shown in FIGS. 4 and 5, the holder 52 is a top-open storage box 53 adapted to hold things.

Figure 6:
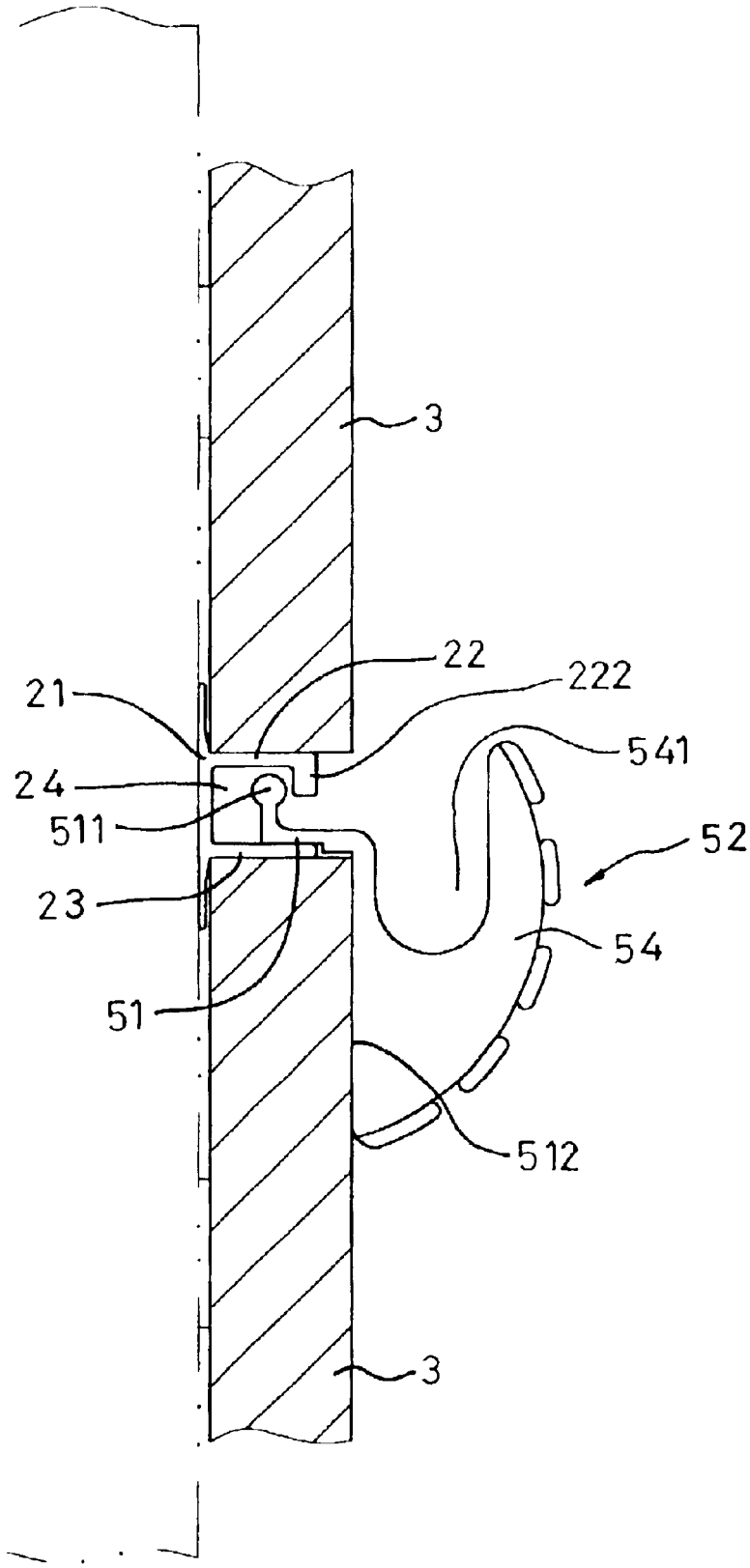
FIG. 6 is a sectional view of the present invention showing an alternate form of the hanging device.

In the embodiment shown in FIG. 6, the holder 52 comprises a hook plate 54 defining a hanging recess 541 adapted to hang things.

Figure 7:
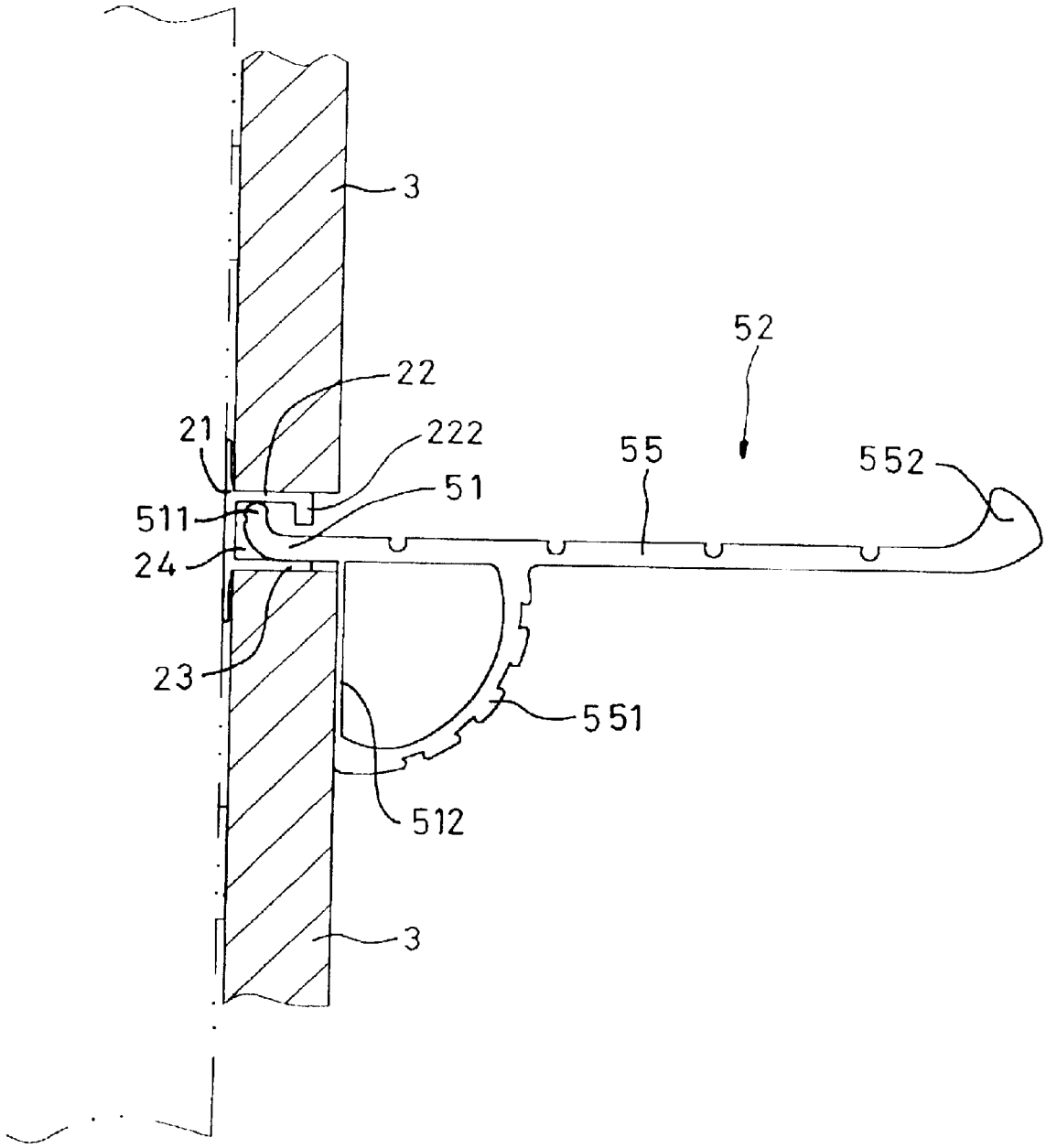
FIG. 7 is a sectional view of the present invention showing another alternate form of the hanging device.

In the embodiment shown in FIG. 7, the holder 52 comprises a bearing plate 55 perpendicularly forwardly extended from the vertical back sidewall 512, and strut 551 connected between the vertical back sidewall 512 and the bearing plate 55 at the bottom side. The bearing plate 55 has an upwardly curved outer stop flange 552 adapted to stop storage things from falling out of the bearing plate 55.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A hanging structure for use with a partition screen having a plurality of partition panels comprising:

a) a one piece spacer located between two vertically spaced partition panels and having:

i) an elongated flat base wall;

ii) a downward locating flange;

iii) an elongated flat bearing wall extending between the elongated flat base wall and the downward locating flange;

iv) an elongated flat supporting wall having a flat top surface extending from the elongated flat base wall to point below the downward locating flange, the elongated flat supporting wall being spaced apart from and parallel with the elongated flat bearing wall, the elongated flat base wall extends above the elongated flat bearing wall and below the elongated fLat supporting wall;

v) an elongated coupling chamber defined by the downward locating flange, the elongated flat bearing wall, the elongated flat base wall, and the elongated flat supporting wall;

vi) an upward stop flange extending upwardly from the elongated flat bearing wall and contacting a first of the two vertically spaced partition panels; and vii) a downward stop flange extending downwardly from the elongated flat supporting wall and contacting a second of the two vertically spaced partition panels; and b) at least one hanging device having:

i) a horizontal extension plate;

ii) a coupling flange upwardly extending from a first end of the horizontal extension plate; and iii) a holder connected to and having a vertical back surface wall extending downwardly from a second end of the horizontal extension plate, wherein the at least one hanging device is positioned within the elongated coupling chamber, the coupling flange presses against the elongated flat bearing wall and is retained by the downward locating flange, the vertical back surface wall contacts a front surface of a lower partition panel, wherein the elongate flat base wall contacts a back surface on each of the two vertically spaced partition panels.

2. The hanging structure according to claim 1, wherein the holder is an open top storage box.

3. The hanging structure according to claim 1, wherein the holder is a hook plate having a hanging recess.

4. The hanging structure according to claim 1, wherein the holder is a bearing plate.

5. The hanging structure according to claim 4, wherein the holder includes a strut located between the bearing plate and the vertical back surface wall.

6. The hanging structure according to claim 4, wherein the bearing plate includes an upwardly curved outer stop flange located on an end opposite the coupling flange.

* * * * *